US005886607A

United States Patent [19]

Ricker

[11] Patent Number: 5,886,607

[45] Date of Patent: Mar. 23, 1999

[54] SIMPLIFIED SOLENOID ASSEMBLY HAVING A PRESS FIT STOP AND METHOD OF ASSEMBLING SAME

[75] Inventor: Russell Ricker, Chichester, N.H.

[73] Assignee: WPI Magnetic, Inc., Warner, N.H.

[21] Appl. No.: 979,119

[22] Filed: Nov. 26, 1997

Related U.S. Application Data

[60] Provisional application No. 60/031,800, Nov. 27, 1996.

[51] Int. Cl.[6] ..... H01F 3/00

[52] U.S. Cl. ..... 335/255; 335/251

[58] Field of Search ..... 335/255, 251, 335/257, 258, 260, 261, 279, 281, 282; 336/192, 198; 251/129.15

[56] References Cited

U.S. PATENT DOCUMENTS

| | | | |
|---|---|---|---|
| 2,353,835 | 7/1944 | Lane et al. | 335/255 |
| 4,306,207 | 12/1981 | Tada et al. | 335/234 |
| 4,518,939 | 5/1985 | Read et al. | 335/262 |
| 4,528,534 | 7/1985 | Read | 335/262 |
| 4,540,154 | 9/1985 | Kolchinsky et al. | 251/129.15 |
| 4,679,767 | 7/1987 | Vollmer et al. | 251/129.15 |
| 5,021,760 | 6/1991 | Krubsack et al. | 335/196 |
| 5,544,857 | 8/1996 | Torrence | 251/129.15 |
| 5,546,064 | 8/1996 | Sallam et al. | 335/261 |

*Primary Examiner*—Renee S. Luebke
*Assistant Examiner*—Tuyen T. Nguyen
*Attorney, Agent, or Firm*—Bourque & Associates, P.A.

[57] ABSTRACT

The solenoid assembly comprises a frame having first and second sides with respective first and second frame apertures extending through the first and second sides. A coil assembly having a first end, a second end and a cavity extending between the first end and the second end. The coil assembly is received in the frame such that the cavity is substantially aligned with the first frame aperture. A plunger is slideably received through the first frame aperture in the frame and into the cavity of the coil assembly. A stop is engaged with an inner surface of the first frame aperture to secure the coil assembly in the frame such that the stop mates with a mating pole face of the plunger. A biasing member, such as a spring, can be positioned between the plunger and the stop, for biasing the plunger toward a de-energized position. The stop preferably has a tapered outer region, for being inserted through the first frame aperture and into the cavity, a substantially flat outer region, for engaging with the inner surface of the first frame aperture, and a barb formed between the tapered outer region and the substantially flat outer region for engaging against the first side portion of the frame.

29 Claims, 6 Drawing Sheets

SIMPLIFIED SOLENOID ASSEMBLY HAVING A PRESS FIT STOP AND METHOD OF ASSEMBLING SAME

RELATED APPLICATION

This application claims the benefit of U.S. provisional patent application Ser. No. 60/031,800 filed Nov. 27, 1996, incorporated herein by reference.

FIELD OF THE INVENTION

The present invention relates to a solenoid assembly and method of assembling and in particular, to a simplified solenoid assembly having a press fit stop and a simplified method of assembling the solenoid.

BACKGROUND OF THE INVENTION

Solenoids are often critical components in higher level electronic and mechanical systems or devices, for example, to provide electro-mechanical actuation. Ongoing efforts at reducing the costs of electronic and mechanical systems have resulted in a need for manufacturing solenoids at a lower cost without effecting the operation of the solenoid and the higher level system in which it is used.

Conventional solenoid constructions include numerous parts that must be assembled, often requiring staking or welding operations to secure the numerous parts in an assembled unit. Such complex existing solenoid constructions prevent high volume and high speed production of the solenoids and prohibit their installation into higher level systems or peripherals in which the solenoids are used. The way in which the parts are assembled and connected in the solenoid also affect the efficiency of the solenoid. Where flux is transferred between the multiple parts or segments of the solenoid, for example, energy is lost at these transfer points.

Accordingly, what is needed is a solenoid assembly having a simplified construction and method for assembling the solenoid that allows solenoids to be produced more efficiently in high volume and high speed automated production and to be more easily assembled into higher level systems. A need also exists for an assembled solenoid that minimizes energy loss between the parts of the solenoid during operation.

SUMMARY OF THE INVENTION

The present invention features a solenoid assembly including a frame having at least first and second sides with respective first and second frame apertures extending through the first and second sides. A coil assembly having a first end, a second end, and a cavity extending between the first and second ends is adapted to be received in the frame such that the cavity is substantially aligned with the first frame aperture. A plunger is adapted to be slideably received through the first frame aperture in the frame and into the cavity of the coil assembly. A stop is adapted to engage with an inner surface of the first frame aperture and secure the coil assembly in the frame such that the stop mates with a mating pole face of the plunger.

In the preferred embodiment, the solenoid assembly includes a biasing member, such as a helical spring, adapted to be positioned between the plunger and the stop for biasing the plunger toward a de-energized position. The coil assembly preferably includes a bobbin including the cavity that extends from a first bobbin aperture to a second aperture, and a coil wound around the bobbin. The bobbin preferably extends through the second frame aperture in the second side of the frame. The plunger preferably includes a shoulder portion, for abutting a shoulder in the bobbin proximate the second bobbin aperture, and a portion of the plunger is adapted to extend through the second bobbin aperture.

The present invention also features an assembled solenoid having the components set forth above.

The present invention also includes the stop used in the assembly described above. The stop includes a tapered outer region, for inserting into the first frame aperture and the cavity of the coil assembly, and a substantially flat outer region, for engaging with an inner surface of the first frame aperture in a press fit. The stop also includes a shoulder disposed at an end of the substantially flat outer region, for abutting the first side portion of the frame proximate the first frame aperture, and a barb formed between the substantially flat outer region and the tapered outer region, for securing against the first side portion of the frame proximate the first frame aperture such that the stop shoulder and the barb are located against opposite side surfaces of the first side portion of the frame.

According to the preferred embodiment of the stop, the tapered outer region begins at a wider point proximate the substantially flat outer region, and a diameter of the substantially flat outer region is smaller than a diameter of the wider point of the tapered outer region to form the barb. The preferred embodiment of the stop also has a generally circular cross-section, and includes a cavity, for receiving the mating pole face of the plunger.

The present invention also features a method of assembling a solenoid having the components set forth above. The method includes the steps of inserting the coil assembly into the frame such that the cavity of the coil assembly is substantially aligned with the first frame aperture, inserting the plunger through the first frame aperture and into the cavity of the coil assembly, and inserting the stop through the first frame aperture and the cavity of the coil assembly, for engaging an inner surface of the frame aperture and securing the coil assembly to the frame. The preferred method further includes the step of inserting a biasing member, such as a helical spring, between the plunger and the stop, for biasing the plunger towards a de-energized position. The step of inserting the stop preferably includes inserting the tapered outer region into the first frame aperture and press fitting the substantially flat outer region into engagement with the inner surface of the first frame aperture until the barb engages the first side portion of the frame proximate the first frame aperture.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
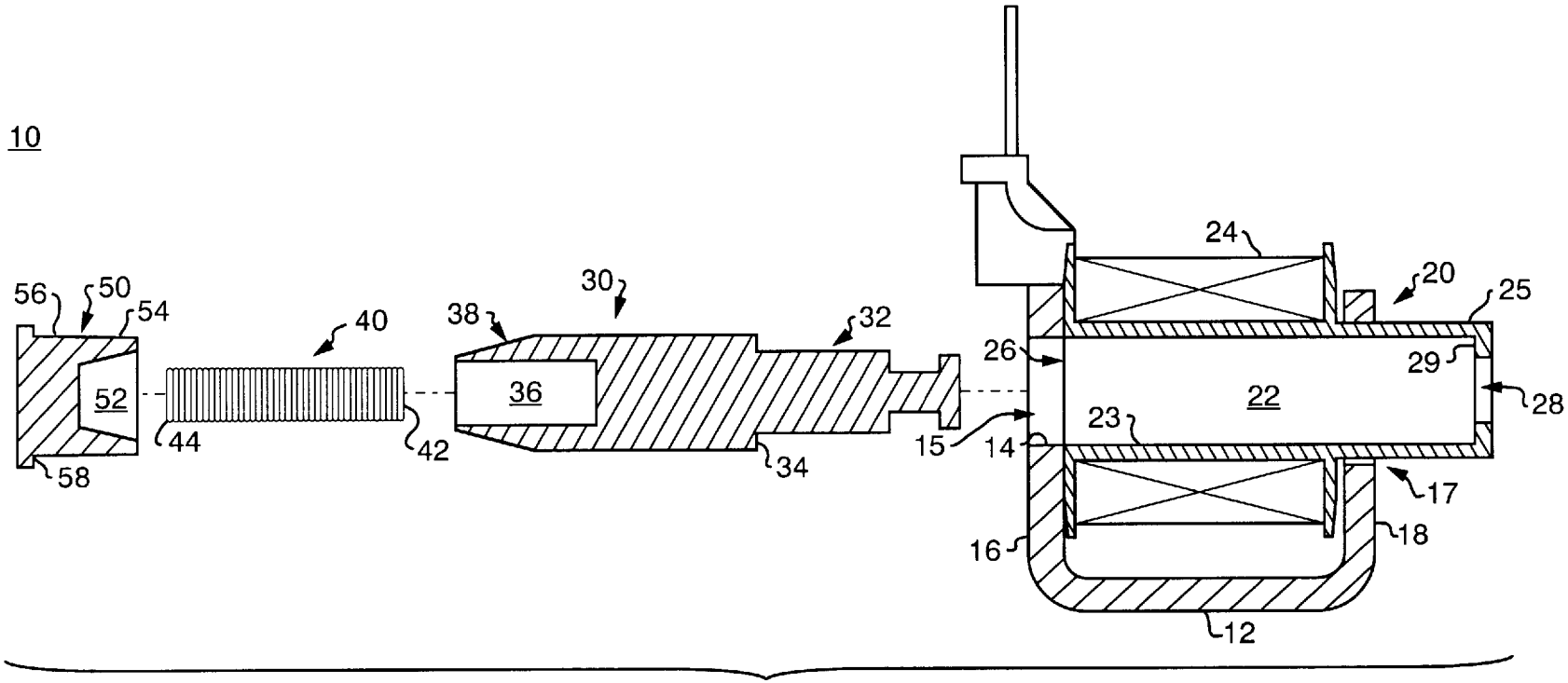
FIG. 1 is an exploded, side cross-sectional view of a solenoid assembly, according to the present invention.

A solenoid assembly 10, FIG. 1, according to the present invention, generally includes a frame 12, a coil assembly 20, an armature or plunger 30, a spring 40, and a stop 50. The coil assembly 20 is snap fit into the frame 12 which is adapted to be mounted or installed into a higher level system. The plunger 30, spring 40 and stop 50 are then assembled into a cavity 22 in the coil assembly 20 to form the assembled solenoid in a fully contained unit 10*a*, FIG. 2.

The frame 12 preferably includes at least first and second sides 16, 18 having respective first and second frame apertures 15, 17. The first frame aperture 15 has an inner surface 14, for engaging with the stop 50 in a press fit, as will be described in greater detail below.

The coil assembly 20 preferably includes a coil or winding 24 wound around at least a portion of a bobbin 25. The cavity 22 of the coil assembly 20 is disposed in the bobbin 25 and extends between first and second bobbin apertures 26, 28 respectively, for receiving portions of the plunger 30. The first bobbin aperture 26 substantially aligns with the first frame aperture 15, and in the exemplary embodiment, a portion of the bobbin 25 extends through the second frame aperture 17. The second bobbin aperture 28 is preferably smaller than the first bobbin aperture 26, forming a shoulder portion 29 adapted to mate with a portion of the plunger 30.

The armature or plunger 30 is slidably received in the cavity 22 within the bobbin 25 of the coil assembly 20. The plunger 30 includes a first end portion or yoke 32 that extends through the smaller bobbin aperture 28 and includes a shoulder portion 34 that mates with or abuts the shoulder portion 29 in the cavity 22 of the bobbin 25. The plunger 30 slides within the cavity 22 generally in the direction of arrow 33 when the solenoid 10*a* (FIG. 2) is energized and de-energized. The plunger 30 further includes a recessed region 36 that receives the spring 40 and a pole face 38 having, for example, a tapered truncated configuration, for mating with the stop 50. The spring 40 includes a first end 42 extending into the recessed region 36 and abutting the plunger 30 and a second end 44, for abutting the stop 50. Alternatively, the spring 40 can be externally disposed around an outer region of the plunger 30.

Figure 2:
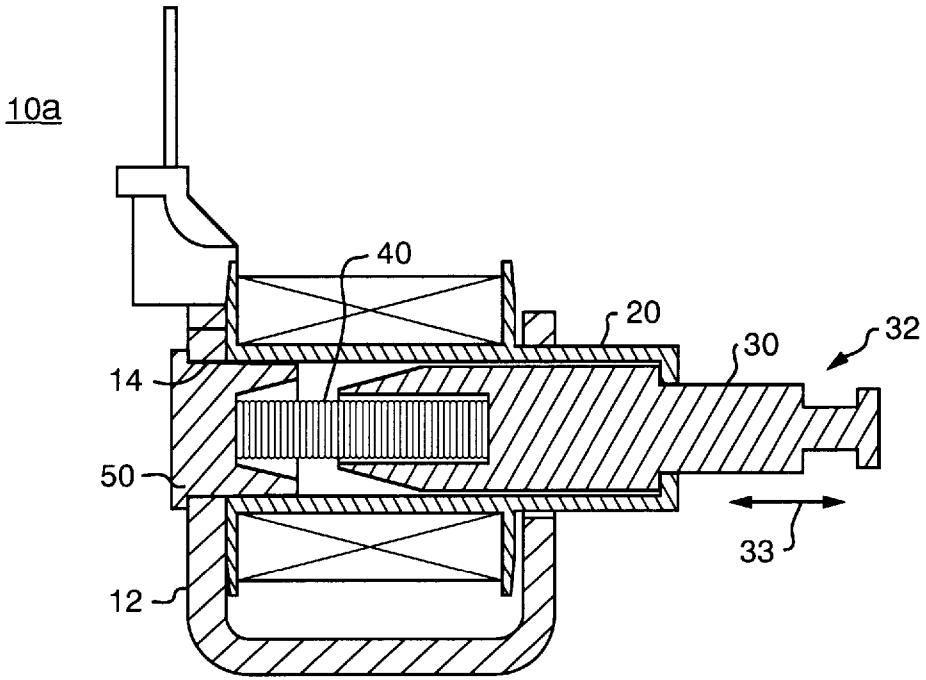
FIG. 2 is a side cross-sectional view of an assembled solenoid assembly, according to the present invention.
Figure 3B:
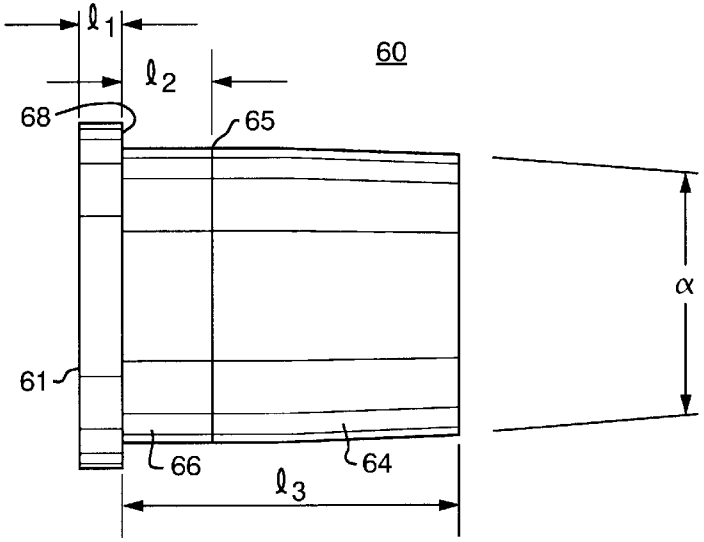
FIGS. 3A–3D are side cross-sectional views of a stop used in the solenoid assembly, according to one preferred embodiment of the present invention.
Figure 3D:
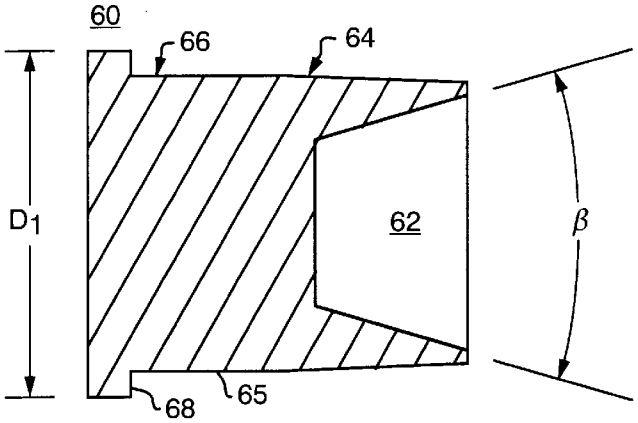
Figure 3A:
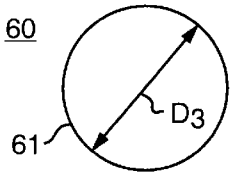
Figure 3C:
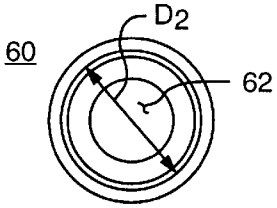

The stop 50 press fits into the first frame aperture 15 and the large bobbin aperture 26 in the bobbin 25 of the coil assembly 20, for holding the plunger 30 and spring 40 in the coil assembly 20 as a single, assembled unit 10*a* (see FIG. 2). The stop 50 includes a recessed region or cavity 52 that receives and retains the second end 44 of the spring 40. The cavity 52 preferably has a tapered configuration matching or mating with the truncated tapered configuration or other configuration of the pole face 38 of the plunger 30. Alternatively, the stop 50 can include a flat face instead of the cavity 52.

The stop 50 further includes a tapered outer region or stop pole face 54 having a gradual taper, for being received in the first bobbin aperture 26 and cavity 22 in the bobbin 25 of the coil assembly 20. When assembling the stop 50, the gradual taper of the stop pole face 54 serves to align the stop 50 with the first frame aperture 15 and the first bobbin aperture 26 in the bobbin 25 of the coil assembly 20. The gradual taper of the stop pole face 54 flattens out to a substantially flat region 56 that engages or fits against the inner surface 14 of the first frame aperture 15 in the frame 12 and/or an inner surface 23 in the bobbin 25 of the coil assembly 20 in a friction fit.

The stop 50 further includes a shoulder 58 that seats against one surface of the first side portion 16 of the frame 12 when the stop 50 has been pressed into the first frame aperture 15 and the bobbin aperture 26, wedging the frame 12, coil assembly 20, and stop 50 together (see FIG. 2). In addition to allowing the solenoid assembly 10 to be easily and securely assembled, the substantially flat surface 56 and shoulder 58 provide a low reluctance joint between the stop 50 and frame 12 when secured in the assembled solenoid 10*a*. The simplified construction of the solenoid assembly 10 thus improves the magnetic efficiency of the solenoid by providing lower reluctance fixed air gaps and eliminating energy losses.

One embodiment of a stop 60, FIGS. 3A–3D, used with the solenoid assembly 10 of the present invention, further includes a barb 65 formed between a substantially flat portion 66 and a tapered pole face 64, for engaging or snapping together with the first side portion 16 of the frame 12 proximate the first frame aperture 15. The diameter D, (FIG. 3D) of the stop 60 at the substantially flat portion 66 is preferably smaller than the diameter $D_2$ (FIG. 3C) of the stop 60 at the widest point of the tapered pole face 64, forming the barb 65. The barb 65 and a shoulder 68 of the stop 60 engage either side of the first side portion 16 of the frame 12 to more securely hold the stop 60 and the entire assembly together, further increasing the structural integrity of the assembled solenoid. The stop 60 is thus self-anchoring and avoids having to be staked or welded into place as in conventional solenoid assemblies.

In one example, the diameter $D_1$ (FIG. 3D) of the stop 60 at the substantially flat portion 62 is about 0.212 inches and the diameter $D_2$ (FIG. 3C) at the widest point of the stop 60 is about 0.216 inches, thereby forming the barb 65. The diameter $D_3$ (FIG. 3A) of an end portion 61 of the stop 60 is about 0.25 inches, thereby forming the shoulder 68.

In one example, the end portion 61 has a length $l_1$ of about 0.032 inches, the substantially flat region 62 has a length $l_2$ of about 0.0635 inches, and the tapered pole face 64 together with the substantially flat region 62 have a length $l_3$ of about 0.256 inches. In this example, the tapered pole face 64 has a taper angle $\alpha$ of about 4.5° and the cavity 62 is formed with a taper angle $\beta$ of about 30°. Although specific dimensions of the stop 60 are shown and set forth above, the present invention contemplates stops having various possible dimensions depending on the desire usage for the solenoid assembly 10.

This solenoid assembly 10, FIGS. 4A–4F, is easily and quickly assembled by inserting the plunger 30, spring 40 and stop 50 through the first frame aperture 15 and the first bobbin aperture 26 in the bobbin 25 of the coil assembly 20 and securing the assembly by pushing the stop 50 into engagement with the inner surface 14 of the first frame aperture 15 in the frame 12 and/or surface 23 of the core assembly 20.

Figure 4A:
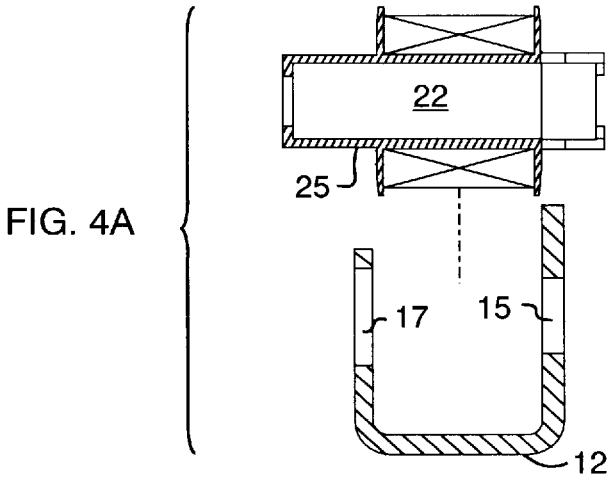
FIGS. 4A–4F are side views of an assembly sequence for the solenoid assembly, according to one embodiment of the present invention.
Figure 4B:
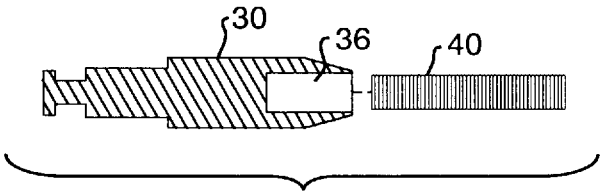
Figure 4C:
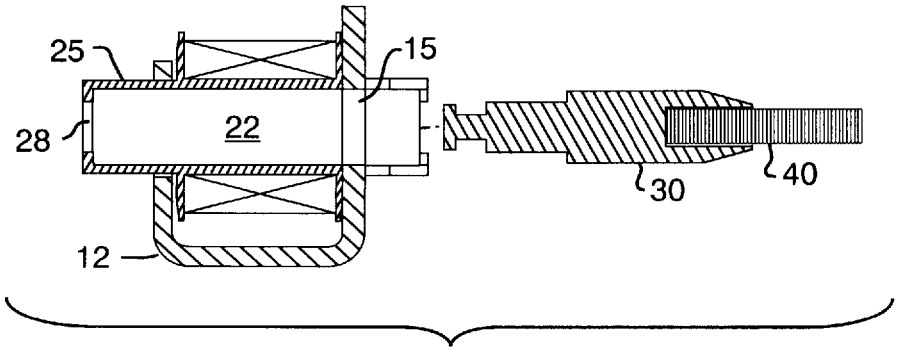
Figure 4D:
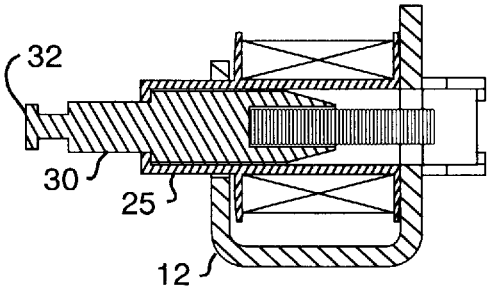
Figure 4E:
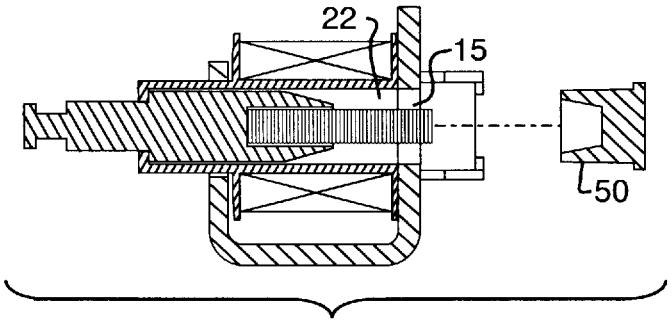
Figure 4F:
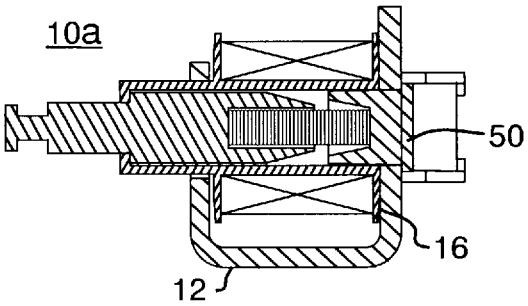

The assembly method begins by inserting the bobbin 25 into the frame 12 such that the cavity 22 within the bobbin 25 is substantially aligned with the first frame aperture 15, FIG. 4A. In one embodiment, a portion of the bobbin 25 extends through the second frame aperture 17, which has a generally U shape. The spring 40, which is preferably a helical compression spring, is inserted into the recessed region 36 of the plunger 30, FIG. 4B. The plunger 30 together with the spring 40 is then inserted through the first frame aperture 15 and into the cavity 22 within the bobbin 20, FIG. 4C. The first end portion 32 of the plunger 30 slides through the cavity 22 and through the second bobbin aperture 28 in the bobbin 25, FIG. 4D. The stop 50 is then inserted through the first frame aperture 15 and into the cavity 22 within the bobbin 25, FIG. 4E, until the stop 50 is engaged in a friction fit with the frame 12, thereby holding the frame 12, coil assembly 20, plunger 30 and spring 40 as one assembled unit 10*a*, FIG. 4F.

Allowing the solenoid assembly 10 to be quickly pushed together enables the solenoid 10 to be assembled in an efficient high volume and high speed automated production process. This simplified construction and assembly requires less time to be assembled and eliminates the staking or welding operations required in assembling existing solenoids.

The assembled solenoid 10*a*, FIGS. 5A–5D, is a fully contained unit that can easily be assembled into higher level assemblies, for example, using three point mounting into the higher level assembly. The yoke 32 provides a quick connect to a load in a higher level assembly. In one example, the solenoid 10*a* is designed to mate with a crimp terminal, such as the type manufactured by AMP.

Figure 5B:
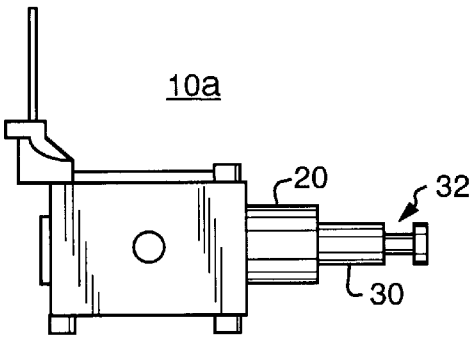
FIGS. 5A–5D are side views of an assembled solenoid according to one embodiment of the present invention.
Figure 5D:
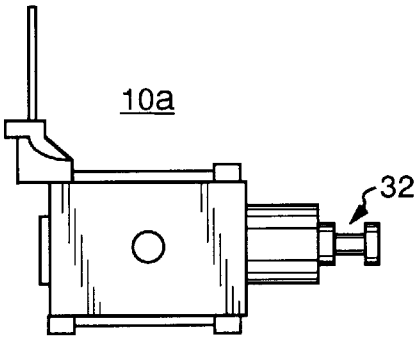
Figure 5A:
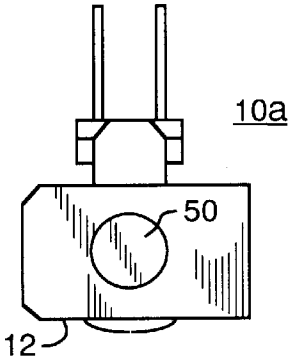
Figure 5C:
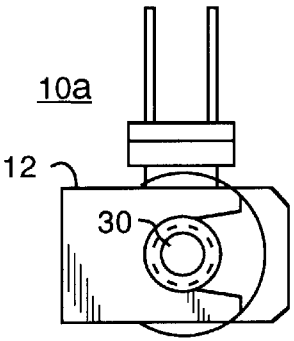

The spring 40 (not shown) preferably biases the plunger 30 toward a de-energized position where the plunger 30 extends out of the coil assembly 20 (FIG. 5B). When energized, the plunger 30 retracts into the coil assembly 20 against the force of the spring 40 (FIG. 5D). In one example, the stroke of the solenoid in the is about 5.0 mm ±0.2 mm., the pull in force when energized is approximately 1.37 ±0.08N, and the spring force is approximately 0.42±0.08N. The present invention contemplates solenoid assemblies having various possible dimensions and operating characteristics depending upon the desired usage or the higher level assembly in which the solenoid is used.

Accordingly, the simplified solenoid construction and assembly method of the present invention allows the solenoid to be produced in a high volume/high speed automated production with a relatively high degree of repeatability. The solenoid assembly is produced as a fully self-contained unit that is easily handled and assembled into a higher level system.

Modifications and substitutions by one of ordinary skill in the art are considered to be within the scope of the present invention which is not to be limited except by the claims which follow.

What is claimed is:

1. A solenoid assembly comprising:

a frame having at least first and second sides with respective first and second frame apertures extending through said first and second sides;

a coil assembly having a first end, a second end, and a cavity extending between said first end and said second end, wherein said coil assembly is adapted to be received in said frame such that said cavity is substantially aligned with said first frame aperture;

a plunger adapted to be slidably received through said first frame aperture in said frame and into said cavity of said coil assembly, wherein said plunger includes a mating pole face; and a stop adapted to engage with an inner surface of said first frame aperture and to secure said coil assembly in said frame such that said stop mates with said mating pole face of said plunger, wherein said stop includes a tapered outer region, for inserting into said first frame aperture, and a substantially flat outer region, for engaging with an inner surface of said first frame aperture in a friction fit.

2. The solenoid assembly of claim 1 further including a biasing member adapted to be positioned between said plunger and said stop, for biasing said plunger toward a de-energized position.

3. The solenoid assembly of claim 2 wherein said biasing member is a helical spring.

4. The solenoid assembly of claim 1 wherein said coil assembly includes:

a bobbin, wherein said cavity is disposed in said bobbin, and wherein said cavity extends from a first bobbin aperture to a second bobbin aperture; and a coil wound around said bobbin.

5. The solenoid assembly of claim 4 wherein a portion of said bobbin extends through said second frame aperture in said second side of said frame.

6. The solenoid assembly of claim 4 wherein said plunger includes a shoulder portion, for abutting a shoulder within said bobbin proximate said second bobbin aperture, and wherein an end portion of said plunger is adapted to extend through said second bobbin aperture.

7. The solenoid assembly of claim 4 wherein said stop includes a barb formed between said substantially flat outer region and said tapered outer region, for securing against said first side portion of said frame proximate said first frame aperture.

8. The solenoid assembly of claim 7 wherein said stop has a generally circular cross-section.

9. The solenoid assembly of claim 8 wherein said tapered outer region begins at a wider point proximate said substantially flat outer region, wherein a diameter of said stop at said substantially flat outer region is smaller than a diameter of said stop at said wider point of said tapered outer region.

10. The solenoid assembly of claim 9 wherein said stop includes a cavity, for receiving said mating pole face of said plunger.

11. A solenoid comprising:

a frame having at least first and second sides with respective first and second frame apertures extending through said first and second sides;

a coil assembly having a first end, a second end, and a cavity extending between said first end and said second end, wherein said coil assembly is received in said frame such that said cavity is substantially aligned with said first frame aperture;

a plunger slidably received through said first frame aperture in said frame and into said cavity of said coil assembly, wherein said plunger includes a mating pole face; and a stop engaged with an inner surface of said first frame aperture in a friction fit and extending partially into said cavity of said coil assembly, wherein said stop secures said coil assembly in said frame and holds said plunger in said cavity of said coil assembly such that said stop mates with said mating pole face of said plunger.

12. The solenoid of claim 11 further including a biasing member positioned between said plunger and said stop, for biasing said plunger into a deactivated position.

13. The solenoid of claim 12 wherein said biasing member is a helical spring.

14. The solenoid of claim 11 wherein said coil assembly includes:

a bobbin, wherein said cavity is disposed in said bobbin, and wherein said cavity extends from a first bobbin aperture to a second bobbin aperture; and a coil wound around said bobbin.

15. The solenoid of claim 14 wherein a portion of said bobbin extends through said second frame aperture in said second side of said frame.

16. The solenoid of claim 14 wherein said plunger includes a shoulder portion, for abutting a shoulder within said bobbin proximate said second bobbin aperture, and wherein a portion of said plunger is adapted to extend through said second bobbin aperture.

17. The solenoid of claim 11 wherein said stop includes a tapered outer region, for inserting into said first frame aperture, and a substantially flat outer region, for engaging with an inner surface of said first frame aperture in a friction fit.

18. The solenoid of claim 17 wherein said stop includes a barb formed between said substantially flat outer region and said tapered outer region, for securing against said first side portion of said frame proximate said first frame aperture.

19. The solenoid of claim 18 wherein said stop has a generally circular cross-section.

20. The solenoid of claim 19 wherein said tapered outer region begins at a wider point proximate said substantially flat region, wherein a diameter of said stop at said substantially flat outer region is smaller than a diameter of said stop at said wider point of said tapered outer region.

21. The solenoid of claim 20 wherein said stop includes a cavity, for receiving said mating pole face of said plunger.

22. A stop for use in a solenoid, said solenoid including a frame having at least first and second sides with respective first and second frame apertures extending through said first and second sides, a coil assembly having a first end, a second end, and a cavity extending between said first end and said second end and substantially aligned with said first frame aperture, and a plunger slidably received through said first frame aperture in said frame and into said cavity of said coil assembly, said stop comprising:

a tapered outer region, for inserting into said first frame aperture and said cavity of said coil assembly;

a substantially flat outer region, for engaging with an inner surface of said first frame aperture in a press fit;

a shoulder disposed at an end of said substantially flat outer region, for abutting said first side portion of said frame proximate said first frame aperture; and a barb formed between said substantially flat outer region and said tapered outer region, for securing against said first side portion of said frame proximate said first frame aperture opposite said shoulder.

23. The stop of claim 22 wherein said stop has a generally circular cross-section.

24. The stop of claim 23 wherein said tapered outer region begins at a wider point proximate said substantially flat outer region, and wherein a diameter of said stop at said substantially flat outer region is smaller than a diameter of said stop at said wider point of said tapered outer region.

25. The stop of claim 24 wherein said stop includes a cavity, for receiving said mating pole face of said plunger.

26. A method of assembling a solenoid, said method comprising the steps of:

providing a frame having at least first and second sides with respective first and second frame apertures extending through said first and second sides, a coil assembly having a first end, a second end, and a cavity extending between said first end and said second end, a plunger including a mating pole face, and a stop;

inserting said coil assembly into said frame such that said cavity of said coil assembly is substantially aligned with said first frame aperture;

inserting said plunger through said first frame aperture and into said cavity of said coil assembly; and inserting said stop through said first frame aperture and said cavity of said coil assembly, for engaging an inner surface of said frame aperture in a friction fit and securing said coil assembly to said frame.

27. The method of claim 26 further including the step of:

inserting a biasing member between said plunger and said stop, for biasing said plunger toward a de-energized position.

28. The method of claim 26 wherein said stop includes a tapered outer region and a substantially flat outer region, and wherein the step of inserting said stop includes:

inserting said tapered outer region into said first frame aperture; and press fitting said substantially flat outer region into engagement with said inner surface of said first frame aperture.

29. The method of claim 28 wherein said stop further includes a barb formed between said substantially flat outer region and said tapered outer region, and wherein the step of inserting said stop further includes press fitting said stop until said barb engages said first side portion of said frame proximate said first frame aperture.

* * * * *